US010391500B2

(12) United States Patent
Larsson et al.

(10) Patent No.: US 10,391,500 B2
(45) Date of Patent: Aug. 27, 2019

(54) CRUSHING SHELL WITH ROTATIONAL LOCK

(71) Applicant: SANDVIK INTELLECTUAL PROPERTY AB, Sandviken (SE)

(72) Inventors: Mikael M Larsson, Eslov (SE); Anders Hallberg, Soddra Sandby (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/738,791

(22) PCT Filed: Jul. 3, 2015

(86) PCT No.: PCT/EP2015/065214

§ 371 (c)(1),
(2) Date: Dec. 21, 2017

(87) PCT Pub. No.: WO2017/005279

PCT Pub. Date: Jan. 12, 2017

(65) Prior Publication Data

US 2018/0161776 A1 Jun. 14, 2018

(51) Int. Cl.
*B02C 2/00* (2006.01)
*B02C 2/04* (2006.01)

(52) U.S. Cl.
CPC ..... *B02C 2/047* (2013.01); *B02C 2/005* (2013.01); *B02C 2/045* (2013.01)

(58) Field of Classification Search
CPC ..... B02C 2/047; B02C 2/005; F16B 2200/50; F16B 2200/503; F16B 2200/506; F16B 31/06; F16B 21/12; Y10T 403/16; Y10T 403/1616
USPC ..... 403/335, 336, 337; 411/21; 137/385
See application file for complete search history.

(56) References Cited

U.S. PATENT DOCUMENTS

| | | | | |
|---|---|---|---|---|
| 1,630,194 | A | 5/1927 | Gunnell et al. | |
| 3,343,612 | A * | 9/1967 | Flowers | E21B 19/087 173/213 |
| 3,534,916 | A | 10/1970 | Decker et al. | |
| 5,769,340 | A * | 6/1998 | Jean | B02C 2/045 241/207 |
| 5,915,638 | A * | 6/1999 | Jean | B02C 2/005 241/207 |
| 7,195,186 | B2 * | 3/2007 | Van Mullem | B02C 2/005 241/207 |
| 10,046,329 | B2 * | 8/2018 | Andersson | B02C 2/04 |
| 2008/0290200 | A1 | 11/2008 | Eriksson et al. | |
| 2015/0174581 | A1 * | 6/2015 | Biggin | B02C 2/04 241/207 |
| 2016/0346786 | A1 * | 12/2016 | Svedensten | B02C 2/005 |

FOREIGN PATENT DOCUMENTS

| | | | |
|---|---|---|---|
| CN | 203678430 | U | 7/2014 |
| EP | 2821140 | A1 | 1/2015 |
| WO | 2004110626 | | 12/2004 |

* cited by examiner

*Primary Examiner* — Shelley M Self
*Assistant Examiner* — Joseph Finan
(74) *Attorney, Agent, or Firm* — Corinne R. Gorski

(57) ABSTRACT

A gyratory crusher shell has an annular wall extending around a longitudinal axis. A plurality of ears project radially outward from an annular rim of the topshell with each ear including a respective lug to sit within a corresponding recess at an annular rim of the topshell to rotatably lock the crushing shell at the topshell.

14 Claims, 7 Drawing Sheets

CRUSHING SHELL WITH ROTATIONAL LOCK

RELATED APPLICATION DATA

This application is a § 371 National Stage Application of PCT International Application No. PCT/EP2015/065214 filed Jul. 3, 2015.

FIELD OF INVENTION

The present invention relates to a gyratory crusher topshell and a topshell assembly in which the crushing shell is axially and rotatably locked within the topshell via a plurality of ears and lock lugs projecting from the shell.

BACKGROUND ART

Gyratory crushers are used for crushing ore, mineral and rock material to smaller sizes. Typically, the crusher comprises a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Primary crushers, such as jaw crushers, are heavy-duty machines designed to process large material sizes of the order of one meter. Secondary and tertiary crushers are intended to process relatively smaller feed materials typically of a size less than 35 centimeters and cone crushers represent a subcategory of gyratory crushers that are typically utilised as downstream crushers due to their high reduction ratios and low wear rates.

A variety of different mechanisms have been described to both axially and rotatably secure the outer crushing shell within the topshell so as to prevent the concave from being pushed out of the topshell and rotating with the gyroscopic precession of the mantle (mounted about the central shaft). U.S. Pat. No. 5,769,340 describes a positioning device in which the concave is provided with a plurality of tabs that sit radially between the concave and the topshell to provide respective abutment surfaces to frictionally grip radially outer regions of the concave so as to maintain it in position.

U.S. Pat. No. 5,915,638 describes the mounting of an outer crushing shell to the topshell via stop blocks that are received within key slots (formed at an upper annular rim of the topshell) to cooperate with separate and independently mounted wedge shaped keying elements that frictionally engage the topshell to provide a rotational lock.

WO 2004/110626 discloses a number of different embodiments for mounting a concave at a topshell via an intermediate spacer ring. The spacer ring is secured to the topshell via flanges that project radially outward from an upper annular rim of the ring to be seated within stepped regions formed in the upper annular rim of the topshell.

However, conventional arrangements are disadvantageous for a number of reasons. In particular, the upper and/or lower annular rims of the topshell are typically subjected to significant loading forces as the topshell is mated against additional components within the crusher such as a spider and the bottom shell. Removing excessive material from the respective topshell upper and lower rims to accommodate locking attachments that engage the crushing shell can weaken the topshell and increases the likelihood of stress concentrations and fracture propagation. Additionally, conventional locking mechanisms commonly employ an axially extending locking bolt that is secured into the topshell to provide the 'stop' for rotationally locking the crushing shell. It is not uncommon for such bolts to shear during use resulting in the concave rotating within the topshell and in some instances falling into the bottom shell and damaging further components of the crusher. Accordingly, what is required is a locking mechanism for a crushing shell that addresses the above problems.

SUMMARY OF THE INVENTION

It is an objective of the present invention to provide a gyratory crusher outer crushing shell adapted for convenient mounting and disassembly from a topshell whilst being mountable reliably to inhibit axial and rotational movement during use without compromising the structural integrity of the topshell and the crushing shell. It is a further specific objective to provide an outer crushing shell locking mechanism that provides a reduced likelihood of failure following extended use and a locking mechanism that is limited only by the operational lifetime of the outer crushing shell as determined by the crushing mechanism of the shell in cooperation with the mantle. It is a further specific objective to provide a shell locking arrangement conveniently adaptable for use with different types of crusher and crushing shell.

The objectives are achieved by providing a gyratory crusher outer crushing shell having a plurality of attachment ears that are configured to be secured to the topshell via separate mechanisms to provide firstly an axial lock with the topshell and secondly a rotational lock within the topshell. Axial locking is achieved by respective locking bolts and rotational locking is achieved by a lug that projects from each ear and is configured to sit within a corresponding recess formed within the annular rim of the topshell. In particular, according to one aspect, each lug projects axially from each ear and depending upon the orientation of the topshell, each lug projects axially downward (in the case of an upper crushing shell) or axially upward into the topshell (in the case of a lower crushing shell). Accordingly, the topshell is specifically adapted via the plurality of recesses at the respective upper or annular rim to receive each lug and mate with the crushing shell.

According to a first aspect of the present invention there is provided a crushing shell for mounting within a gyratory crusher topshell, the crushing shell comprising: an annular wall extending around a longitudinal axis, the wall terminated at an axial end by an annular rim; a plurality of fastening ears projecting radially outward from the wall at the region of the rim, each ear being attachable to an annular rim of a topshell of a gyratory crusher; characterised by: a lock lug projecting from each ear to be received within respective recesses at the annular rim of the topshell to rotatably lock the crushing shell at the topshell.

Preferably, each ear comprises a hole or notch to receive an attachment bolt for securing axially the crushing shell to the topshell. Preferably, each notch is formed as a cut-out section or indent extending radially inward from an outer perimeter edge of the ear in a direction towards the central axis around which the annular wall of the topshell extends. Preferably, the notch does not extend the full radial length of the ear so as to enhance the structural integrity of the ear to withstand the rotational sheer forces. Preferably, the notch is formed approximately at a mid-length region of each ear (in the circumferential direction).

Preferably, each lug projects axially from each respective ear. Such an arrangement is advantageous to enable the ear to sit on top (or below) the topshell rim so that the lug projects axially into the rim to sit within the recess. Accordingly, the topshell rim is adapted only to receive the lock lug and not the ear. Such an arrangement is advantageous to minimise the volume of material removed from the topshell rim to accommodate the lug and accordingly maintain the structural integrity of the topshell and minimise the likelihood of stress concentrations and fracture.

Preferably, each lug comprises an abutment surface to contact a corresponding abutment surface that in part defines each respective recess. More preferably, the abutment surface is substantially planar. Such an arrangement is advantageous to provide an effective surface through which loading forces are transmitted from the crushing shell to the topshell so as to distribute the loading forces evenly into the ear and avoid stress concentrations. Preferably, each lug extends across substantially the full radial width of each ear. The lug radial width is optimised for force transfer between crushing shell and topshell whilst minimising the size of the lug so as to in turn minimise the size of the recess in the topshell rim to avoid weakening the rim. Moreover, and preferably each lug comprises a length in a circumferential direction around the axis that is less than half of a corresponding circumferential length of each ear. Additionally, each lug may comprise a cross sectional area in a plane perpendicular to the axis that is at least half of the corresponding cross sectional area of each ear. Accordingly, the lug volume is less than the ear to minimise the size of the recess within the topshell rim. The size of the lugs therefore represents a compromise between maximising the loading force transfer (to avoid stress concentrations) and minimising the volume of the recesses within the topshell rim that receive the lugs (to avoid weakening the taper fit rims of the topshell). Optionally, a circumferential length of each lug is greater than a radial width of each lug. Such an arrangement is advantageous to strengthen the lug at the ear to avoid stress concentrations and to avoid cracking of the lug at the junction with the ear. Preferably, the lug is formed integrally with the ear and the ear is formed integrally with the crushing shell. Preferably, the lock lug does not project circumferentially or radially outward beyond each ear.

Preferably, the shell comprises between two to six ears each having a respective lug. Optionally, the crushing shell may comprise four to six ears symmetrically arranged around the axis and spaced apart from one another in a circumferential direction by a uniform separation distance. This configuration provides sufficient distribution of the rotational sheer forces around the crushing shell and the topshell.

According to a second aspect of the present invention there is provided a gyratory crusher topshell assembly comprising: a topshell terminated at an axial end by an annular rim; a crushing shell as claimed herein; a plurality of attachment bolts to extend through each ear and the annular rim of the topshell to axially lock the crushing shell at the topshell; and a plurality of recesses provided at the annular rim of the topshell to receive the respective lugs.

Preferably, the assembly further comprises at least one extractor mounted at the topshell and comprising an axially adjustable shaft having an engaging end positioned to contact respectively at least one of the lugs to force axially movement of the crushing shell relative to the topshell. Preferably, the extractor comprises an elongate bolt extending axially through a region of the topshell having a head engagable by a tool for rotation and an opposite end positioned adjacent the lug when installed within the topshell. Preferably, the assembly comprises a plurality of extractor bolts to engage each respective lug or each respective ear. Accordingly, each extractor bolt is separately axially adjustable.

In one aspect, the topshell comprises an axially upper annular rim and an axially lower annular rim and the assembly further comprises: a first axially upper crushing shell secured via the ears, lugs and recesses to the upper annular rim of the topshell; and a second axially lower crushing shell secured via the respective ears, lugs and recesses to the lower annular rim of the topshell. Accordingly, the lugs of the upper shell project axially downward into the upper rim and the lugs of the lower shell project axially upward to the lower rim.

According to a third aspect of the present invention there is provided a gyratory crusher comprising a topshell assembly as claimed herein.

According to a fourth aspect of the present invention there is provided a gyratory crusher topshell assembly comprising: a topshell terminated at an axial end by an annular rim, a crushing shell mounted at the topshell at or towards the annular rim; an axial and rotational lock mechanism to axially and rotationally lock the crushing shell at the topshell; and at least one extractor mounted at the topshell and comprising an axially adjustable shaft having an engaging end positioned to contact a region of the crushing shell to force axial movement of the crushing shell relative to the topshell.

Preferably, the assembly comprises a plurality of extractors in the form of elongate bolts axially adjustable through respective regions of the topshell.

The extractor is advantageous to initiate the axial pushing of the crushing shell from the topshell that is often difficult following extended use of the crusher as the crushing shell becomes fused to the topshell due to the compressive crushing forces.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
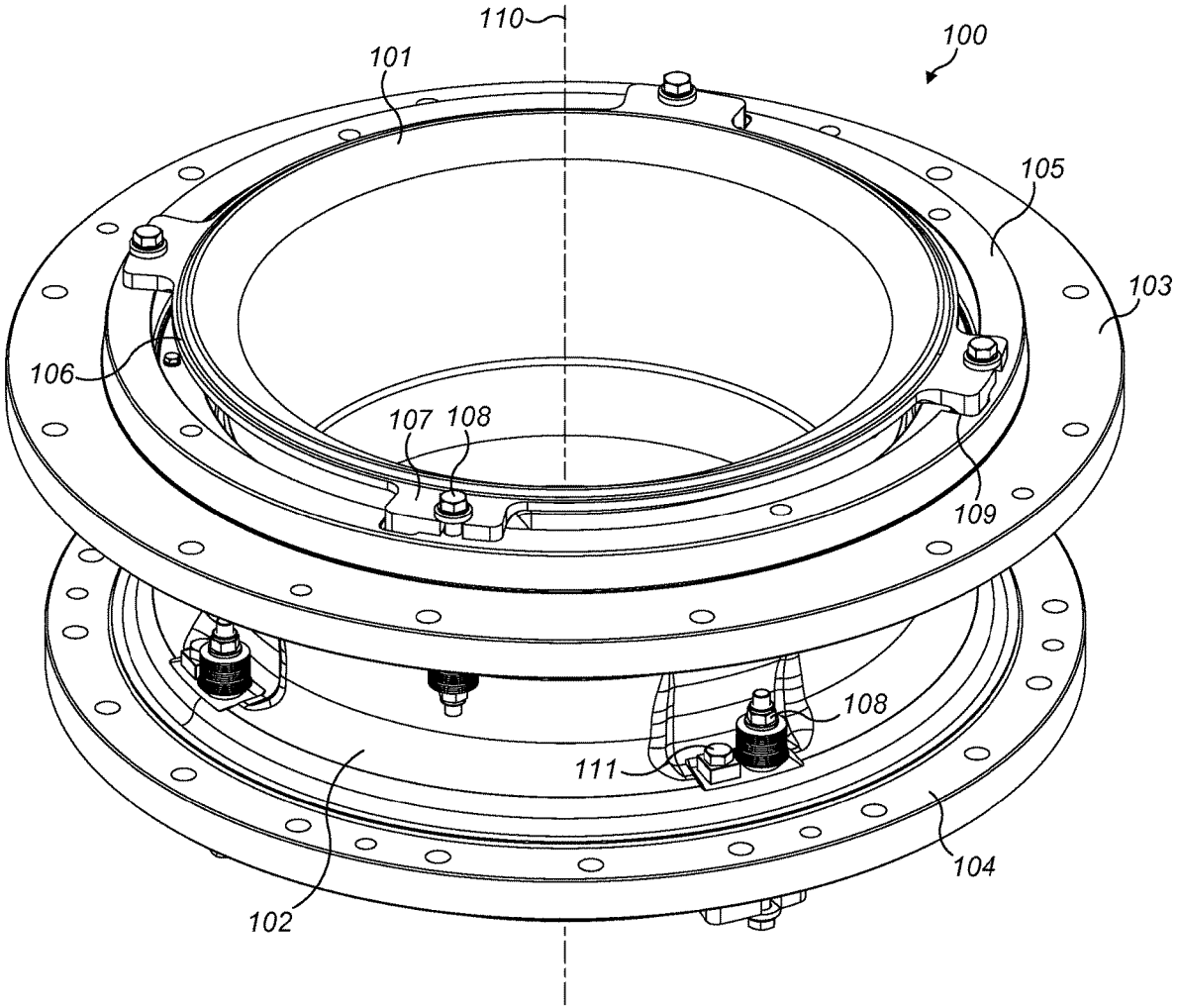
FIG. 1 is an upper external perspective view of a topshell assembly comprising an axially upper and lower outer crushing shell secured in position within a topshell via fastening ears and lock lugs according to a specific implementation of the present invention.
Figure 2:
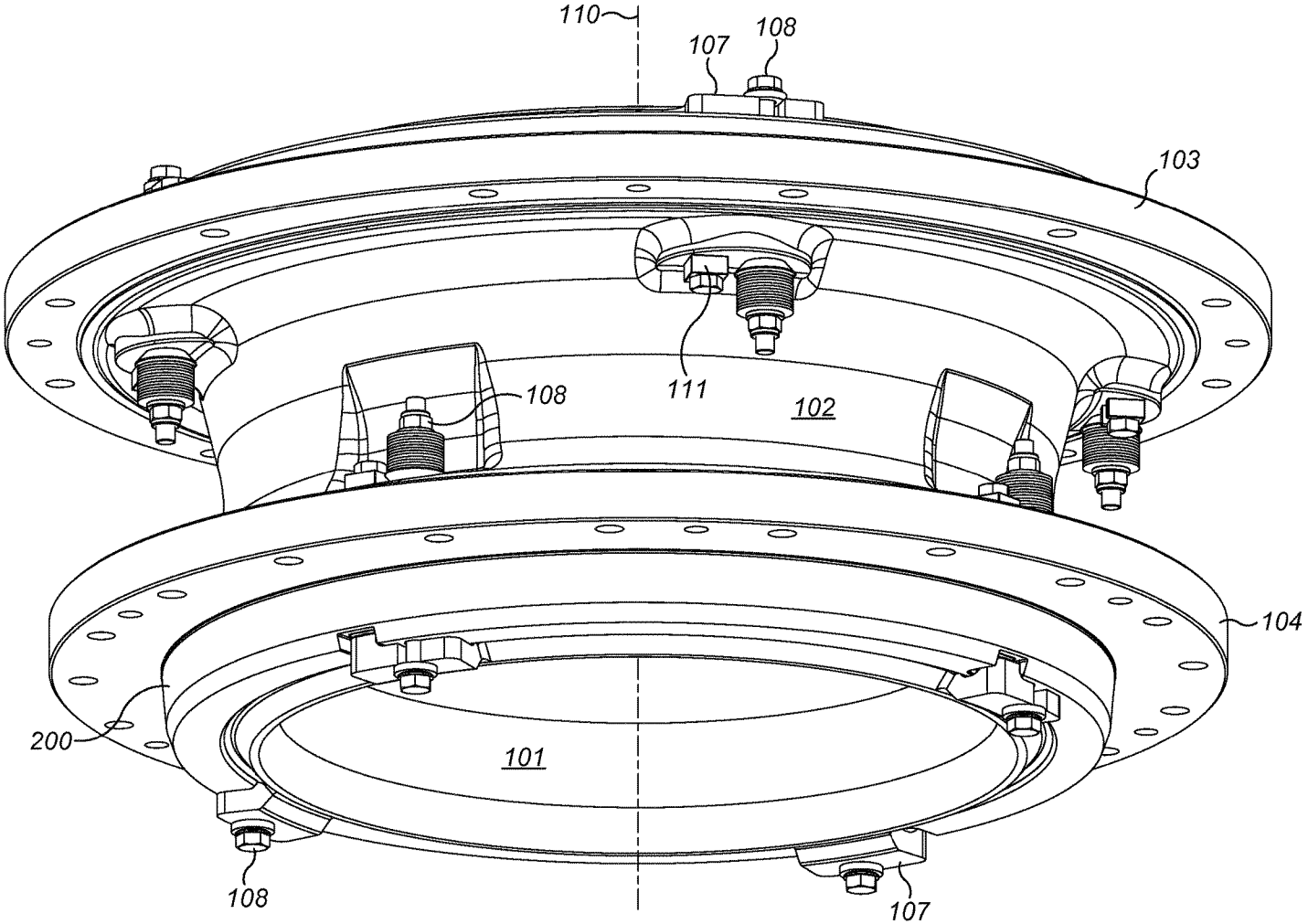
FIG. 2 is a lower external perspective view of the topshell assembly of FIG. 1.

Referring to FIGS. 1 and 2, shell assembly 100 comprises a topshell indicated generally by reference 102 having a generally annular configuration extending around central axis 110. Topshell 102 comprises an upper annular rim 103 separated axially from a lower annular rim 104. An annular tapper-fit collar 105 projects axially from a radially inner region of upper annular rim 103 and a corresponding tapper-fit collar 200 projects axially from lower annular rim 104. Collar 105 and rim 103 provide a mounting for a crusher spider (not shown) representing an upper region of the gyratory crusher. Similarly, lower annular collar 200 and rim 104 provide regions for mounting top shell 102 on a corresponding bottom shell (not shown) of the crusher. As with conventional topshell configurations, collars 105, 200 comprise a radial thickness being less than the respective rims 103, 104.

Figure 4:
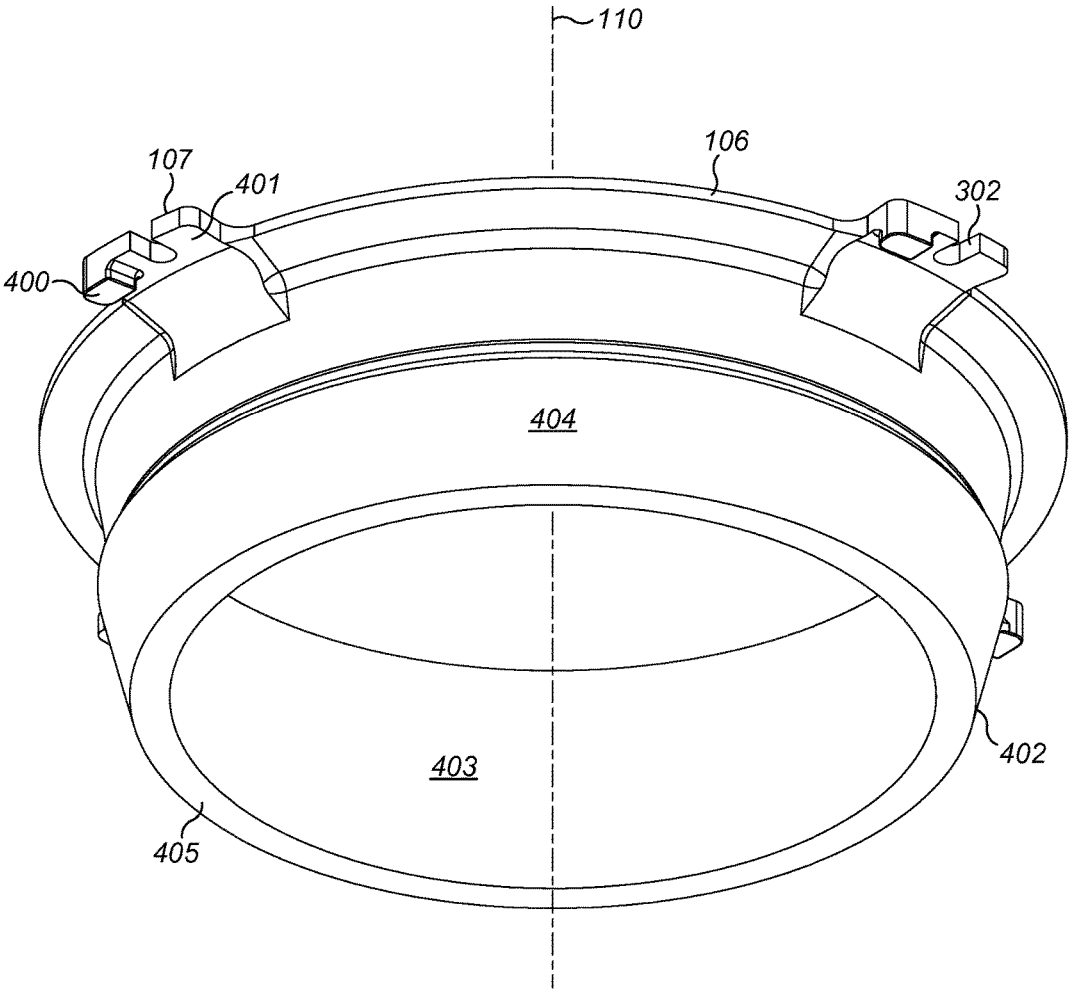
FIG. 4 is a perspective view of one of the outer crushing shells of FIG. 1.
Figure 5:
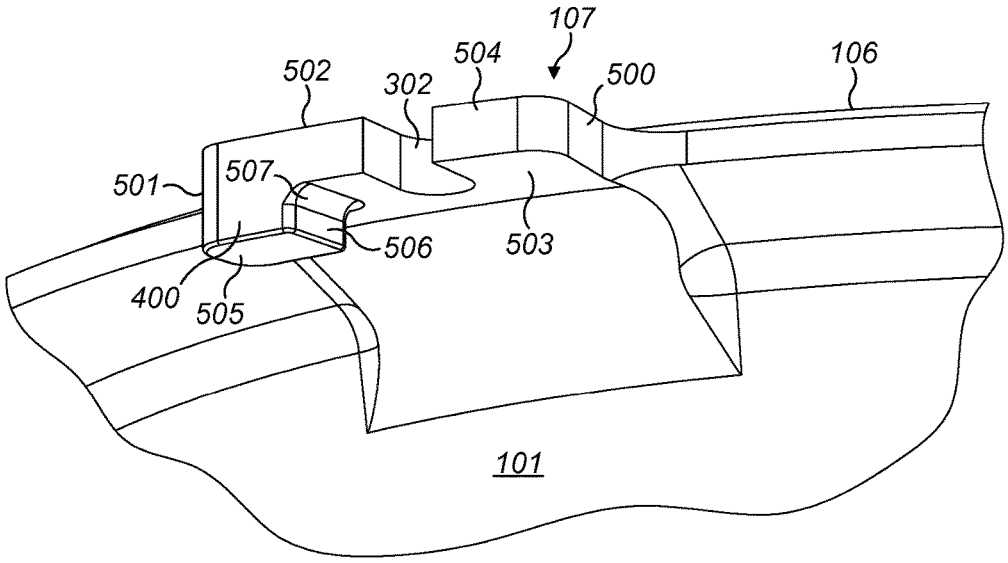
FIG. 5 is a perspective view of one of the fastening ears and lock lugs projecting radially outward from an upper annular rim of topshell of FIG. 4.

Assembly 100 comprises a first outer crushing shell (concave) 101 secured at topshell 102 via rim 103 and collar 105. Assembly 100 further comprise a second crushing shell 101 secured to topshell 102 via the lower rim 104 and collar 200. Each crushing shell 101 comprises an end annular rim 106 and four fastening ears indicated generally by reference 107 projecting radially outward from rim 106 and being spaced apart from one another by a uniform separation distance in a circumferential distance around axis 110. Referring to FIG. 4, topshell 101 comprises an annular wall 405 extending around axis 110 to define a radially outward facing surface 402 for positioning against a radially inward facing surface of topshell 102. Shell 101 further comprises a radially inward facing 'crushing' surface 403 for positioning opposed to an inner crushing shell and mounted on the gyratory crusher main shaft and shaft head (not shown). Each ear 107 comprises an axially projecting lock lug 400. Lock lug 400 is positioned at a first half of fastening ear 107 in a circumferential direction (around axis 110) relative to a second half or region 401 of ear 107. Lock lug 400 is separated from ear region 401 by a notch 302 representing a cut-out portion being recessed into ear 107 in a radially inward direction from a radially outer surface of ear 107. As illustrated in FIG. 4, the four ears 107 project radially outward from shell outer surface 404 at an axial position corresponding to rim 106. A corresponding opposite annular end of shell 101 is devoid of fastening ears 107 so as to sit in a mid-axial region within topshell 102 at an approximate mid-length distance between the upper and lower annular rims 103, 104.

Each upper and lower outer crushing shell 101 is secured axially at each respective collar 105, 200 via ears 107 and a corresponding locking bolt 108. Each bolt 108 projects axially through a region of topshell 102 from each respective collar 105, 200. Each bolt 108 is received respectively within each ear notch 302 so as to be located within the body of each ear 107 circumferentially between each respective lock lug 400 and region 401. As each bolt 108 is tightened, each shell 101 is forced and compressed axially against topshell 102 and in particular each respective collar 105, 200. Additionally, crushing shell 101 is rotationally locked at topshell 102 via each ear 107 engaging with selected regions 109 of each rim 103, 104 as described in detail below. Topshell assembly 100 further comprises a shell extractor formed from a plurality of bolts 111 positioned immediately adjacent each locking bolt 108 so as to extend axially through topshell 102. Each extractor bolt 111 is configured to axially abut each respective lock lug 400 as described with reference to FIG. 8.

Figure 3:
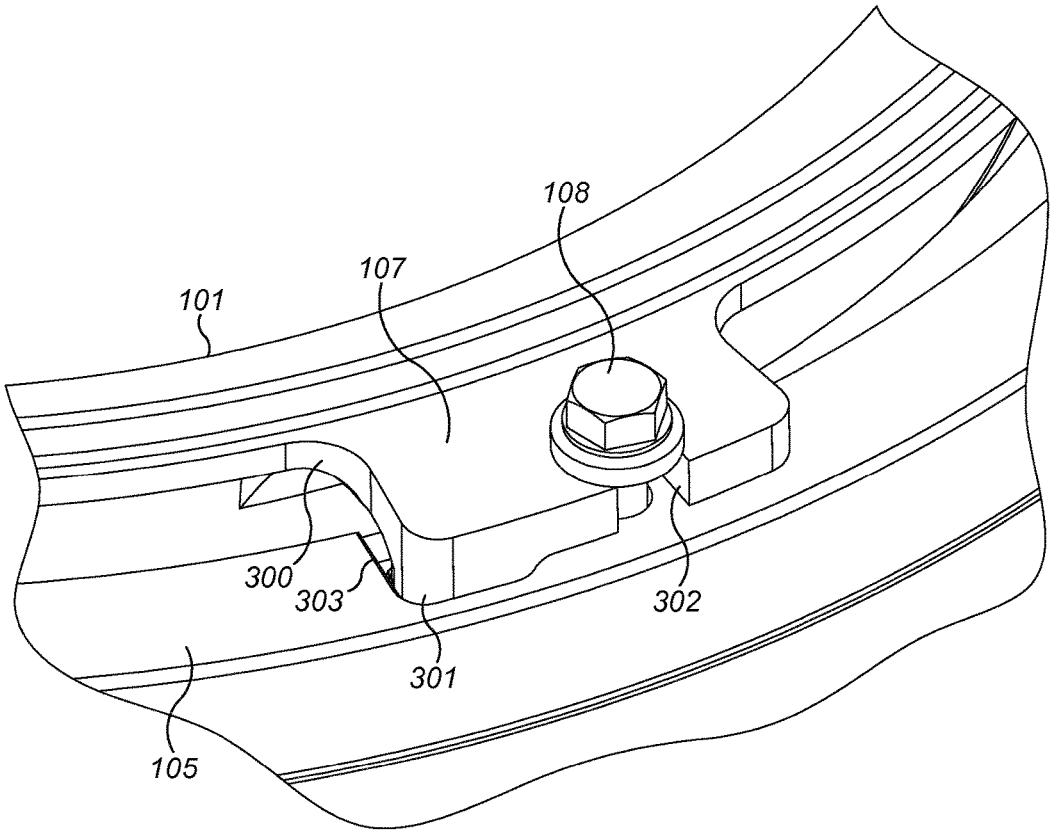
FIG. 3 is a magnified view of one of the fastening ears and lock lugs positioned at an upper annular rim of the top shell assembly of FIG. 1.
Figure 6:
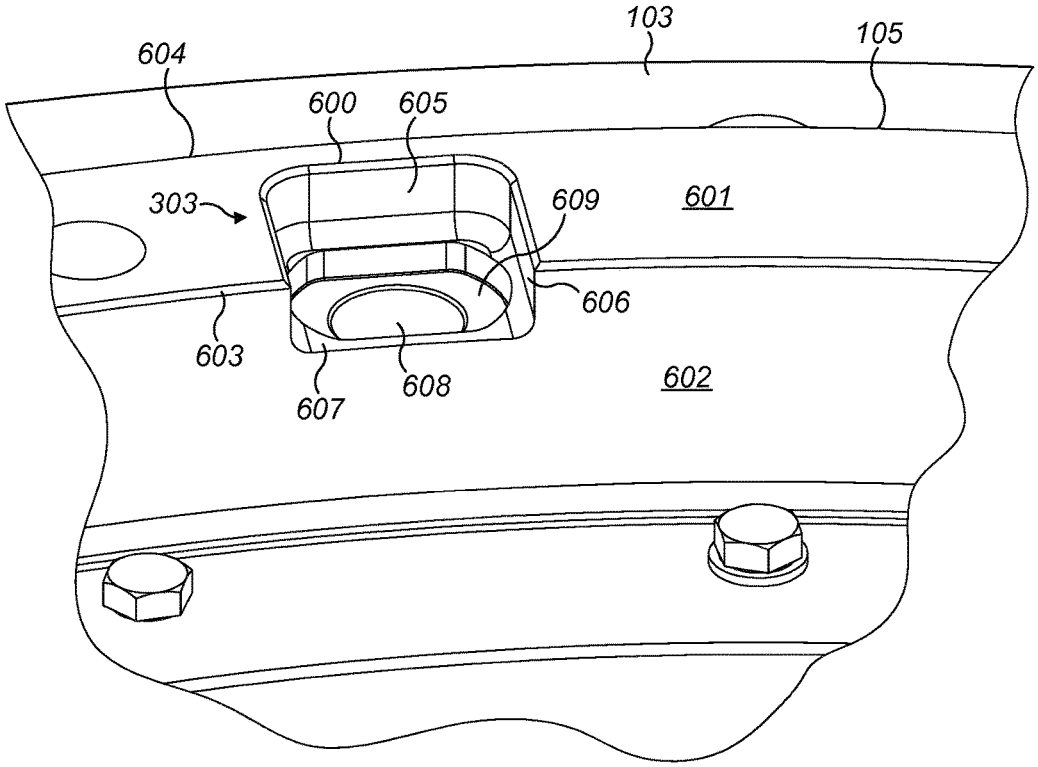
FIG. 6 is a perspective view of one of a plurality of recesses formed in the upper annular rim of the top shell of FIG. 1.

Referring to FIGS. 3, 4 and 6, each ear 107 projects radially outward from rim 106 so as to comprise a radially inner region indicated generally by reference 300 and a radially outer region indicated generally by reference 301 such that notch 302 extends radially into ear 107 from region 301. Accordingly, and referring to the upper crushing shell 101 secured to upper collar 105, each ear 107 comprises a substantially planar upper face 502 and a corresponding substantially planar lower face 503. Ear 107 comprises a front face 500 and a rear face 501 (in a circumferential direction) and a corresponding radially outer face 504 positioned furthest from axis 110 such that notch 302 projects radially inward from outer face 504. Lock lug 400 extends axially downward from lower face 503 (when shell 101 is orientated for attachment to upper collar 105). Each lug 400 comprises an abutment face 506 that is substantially planar and extending in both a radial and axial direction so as to be generally perpendicular to upper and lower faces 502, 503 and substantially parallel with end faces 500, 501 of ear 107. Lug 400 comprises a transition region 507 that is flared outward in a circumferential direction from abutment face 506 at the junction with lower face 503. A curvature of transition region 507 is advantageous to minimise stress concentrations at lug 400 and ear 107 due to contact with collar 105. Lug 400 comprises a generally rectangular cross sectional profile in a plane perpendicular to axis 110. Additionally, ear 107 also comprises a generally rectangular cross sectional profile in the corresponding plane with the cross sectional area of lug 400 being of the order of one third of that of ear 107. As the relative axial thicknesses of lug 400 and ear 107 are approximately similar, a general size of lug 400 is approximately one third of the size of ear 107. Lug 400 is formed integrally with ear 107 that is in turn formed integrally with the annular wall 405 of shell 101. Accordingly, each lug 400 defines a 'stepped' abutment at each ear 107 and represents a projection to extend axially into a region of the respective collars 105, 200. Each lug 400 therefore is configured to provide a rotational lock of shell 101 at topshell 102 that is effective to isolate locking bolts 108 from sheer forces that would otherwise result from forces transmitted to shell 101 from the rotating head within the crusher (not shown). Accordingly, the subject invention is advantageous to avoid sheering of bolts 108 and the detachment of shell 101 relative to topshell 102.

Referring to FIGS. 3 and 6, four recesses indicated generally by reference 303 extend axially into collar 105 from an upper annular face 601 of collar 105 such that each recess 303 comprises an edge 600 (positioned at face 601) that defines a mouth to receive a respective lug 400. Four corresponding recesses 303 are similarly formed within collar 200 at lower rim 104. Each recess 303 extends radially outward from a radially inner face 602 of collar 105 to extend between collar inner and outer edges 603, 604. Each recess 303 comprises a generally rectangular cross sectional profile in a plane perpendicular to axis 110 and has an axial depth being less than the axial height by which collar 105 projects from annular rim 103. In particular, the axial depth of each recess 303 is approximately one third of the axial height of collar 105 relative to rim 103. Each recess 303 is defined by a first face 605 and a pair of opposed end faces 606 such that each recess 303 is open at collar upper face 601 and collar inner face 602 to define a pocket to receive a corresponding lock lug 400. Each recess 303 comprises a trough or base face 607 configured for positioning opposed to the underside face 505 of lug 400. Additionally, lug abutment face 506 is configured to abut one of the recess end faces 606 when lug 400 is accommodated within each recess 303 so as to rotational lock shell 101 within topshell 102. A depression 609 extends axially from recess base face 607 and is provided in communication with an axially extending bore 608 illustrated in more detail referring to FIG. 8.

Figure 7:
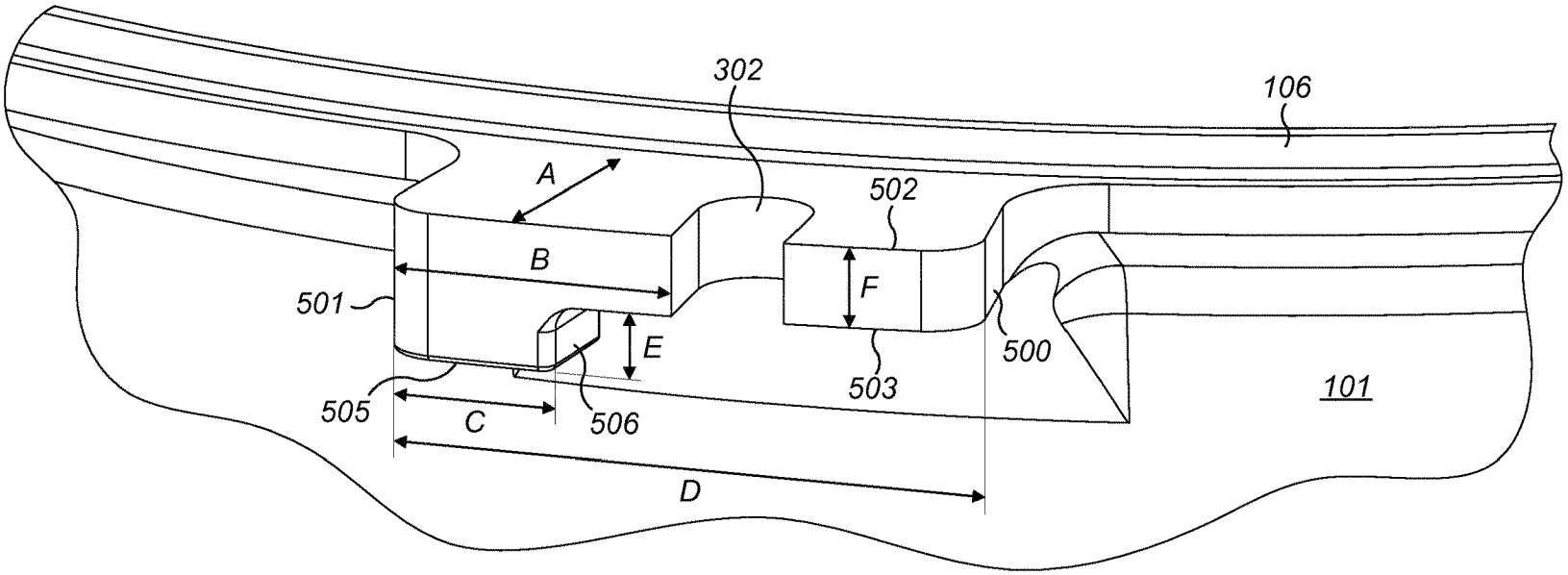
FIG. 7 is a further perspective view of one of the fastening ears and lock lugs of FIG. 5.

Referring to FIG. 7, a thickness F of ear 107 in the axial direction between upper and lower faces 502, 503 is approximately equal to and slightly greater than a corresponding axial thickness E of lug 400 as defined between lug underside face 505 and ear lower face 503. The combined thickness F and E is less than the axial thickness of collar 105 (the distance collar 105 projects axially from rim 103). A length C in a circumferential direction of lug 400 is approximately one third of the total circumferential length D of ear 107 between end faces 500, 501. Additionally, length C, as defined between abutment face 506 and ear end face 501 is approximately half of a distance B in the circumferential direction between ear end face 501 and notch 302. Notch 302 is positioned in a circumferential direction closer to end face 500 relative to end face 501 such that the relative size of the ear 107 from which lug 400 extends is greater than the size of ear region 401 (that is devoid of the lug 400). Each lug 400 extends substantially the full radial width A of each ear 107. Accordingly, the radial width of each lug (corresponding to length A) is less than the corresponding circumferential length C that is advantageous to strengthen lug 400 against sheer forces resulting from abutment between faces 506 and 606. Additionally, a width of each notch 302, in the circumferential direction, is greater than a diameter of each bolt 108 so as to provide a small circumferential gap between these two components 302, 108 when lugs 301 are located with the respective recesses 303. Such an arrangement is advantageous to isolate bolts 108 from rotational forces that are instead transmitted though each of the lugs 301.

Figure 8:
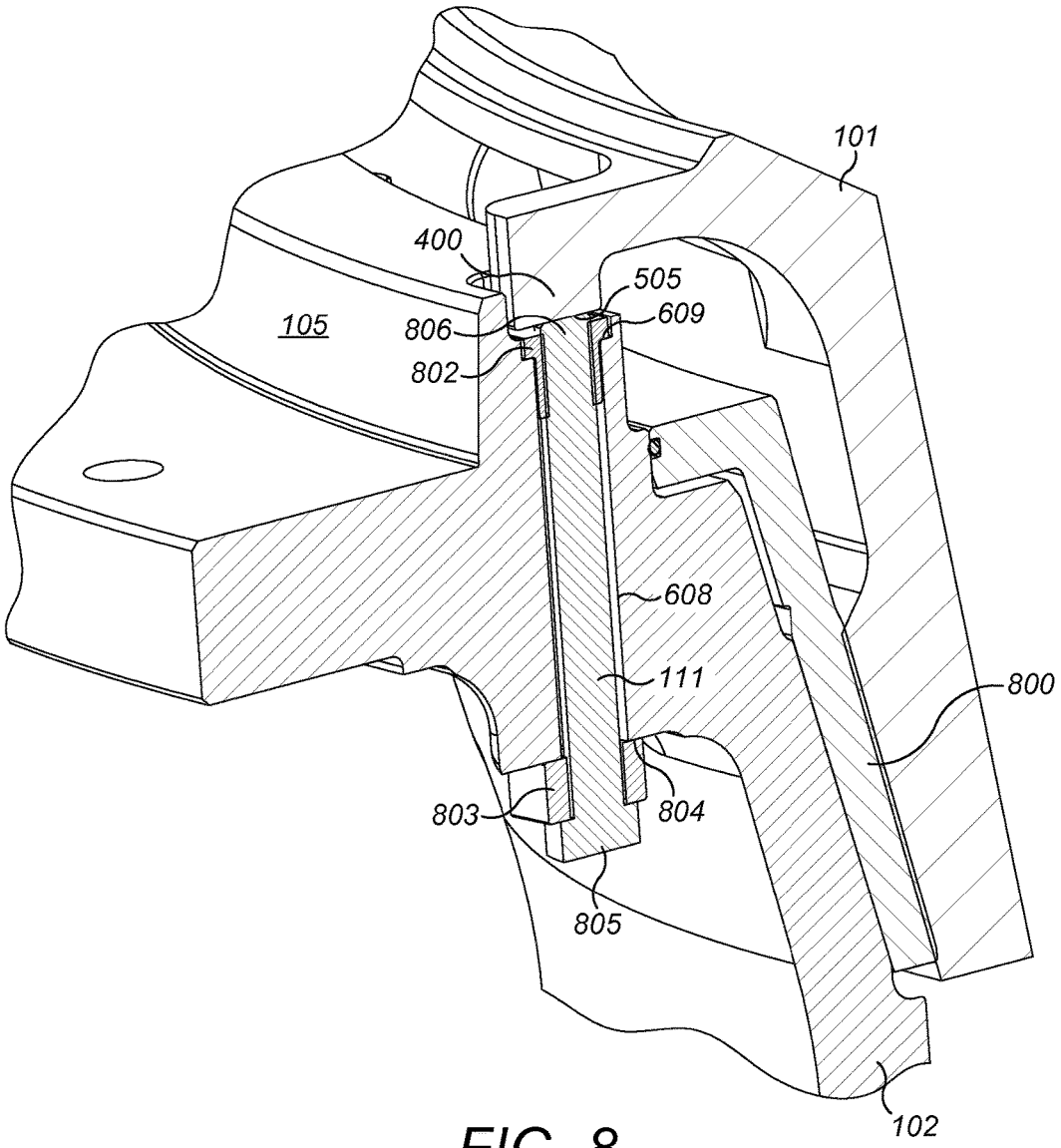
FIG. 8 is a cross sectional perspective view through the topshell assembly of FIG. 1 at the region of an extractor mounted at the topshell to force axial movement of the crushing shell relative to the topshell according to a specific implementation of the present invention.

Referring to FIG. 8, topshell assembly 100 is configured for the convenient detachment of each crushing shell 101 from topshell 102. As an initial stage, locking bolts 108 untightened to release the clamping engagement of shell 101 at collar 105. As is common with outer crushing shells following use, each shell 101 becomes frictionally locked to the inner surface of the topshell 102 that prevents axial detachment. Accordingly, the present arrangement is advantageous to force each shell 101 axially from topshell 102 without the need for additional tools and aggressive agitation that may otherwise damage topshell 102. In particular, the plurality of lock bolts 111 extend through bores 608 between a mount region 804 that co-mounts one end of lock bolts 108. Each extractor bolt 111 comprises a tightening head 805 at a first end and an abutment flange 802 at a second end 806. Abutment flange 802 is formed as an annular collar being flared radially outward at end 806 and shaped to sit within depression 609 is close fitting contact. Flange 802 is secured to bolt end 806 so as to be axially movable with the main shaft of bolt 111. With shell 101 axially and rotationally locked at topshell 102, extractor bolts 111 are axially locked within each bore 608 via a fork washer 803 positioned between mount region 804 and bolt head 805. Once the lock bolts 108 have been removed, fork washer 803 is then removed to allow axial adjustment of extractor bolts 111 relative to each collar 105, 200 and in particular each recess 303. That is, with the lock lugs 400 accommodated with recesses 303, flange 802 is advanced axially to contact lug underside face 505. By axially advancing each extractor bolt 111 through bore 608, shell 101 is forced (via each lock lug 400 and ear 107) axially from topshell 102.

According to further specific implementations, topshell assembly 100 may comprises a single outer crushing shell 101 secured only to the upper collar 105 and annular rim 103. The subject invention may be utilised to secure axially and rotational a crushing shell 101 at topshell 102 directly or via an intermediate spacer ring 800 as illustrated in FIG. 8. According to further embodiments, each crushing shell 101 may comprise 3, 5 or 6 lock ears and respective lugs to provide the separate axial and rotational lock mechanisms. The subject invention is advantageous to minimise sheer and stress forces at the axial locking bolts 108 so as to optimise the axial and rotational locking mechanisms by which the crushing shell 101 is maintained at topshell 102 and minimise the risk of lock failure.

The invention claimed is:

1. A crushing shell arranged to be mounted within a gyratory crusher topshell, the crushing shell comprising:
   - an annular wall extending around a longitudinal axis, the wall being terminated at an axial end by an annular rim;
   - a plurality of fastening ears projecting radially outward from the wall at a region of the rim, each ear being engageable with an annular rim of the topshell of a gyratory crusher, each ear having a notch; and
   - a lock lug projecting from each ear and arranged to be received within respective recesses at the annular rim of the topshell to rotatably lock the crushing shell at the topshell, each lug having a length in a circumferential direction around the longitudinal axis that is less than half of a corresponding circumferential length of a respective ear, wherein the circumferential length of each lug is greater than a radial width of each lug, and the circumferential length of each lug is about half of a distance in the circumferential direction between an end face of the ear and the notch.

2. The crushing shell as claimed in claim 1, wherein each notch is arranged to receive an attachment bolt for securing axially the crushing shell to the topshell.

3. The crushing shell as claimed in claim 1, wherein each lug projects axially from a respective ear.

4. The crushing shell as claimed in claim 1, wherein an abutment face of each lug is arranged to contact a corresponding face that in part defines each respective recess of the rim of the topshell.

5. The crushing shell as claimed in claim 4, wherein the abutment face is planar.

6. The crushing shell as claimed in claim 1, wherein each lug extends across a full radial width of a respective ear.

7. The crushing shell as claimed in claim 1, wherein each lug has a cross section area in a plane perpendicular to the axis that is at least half of the corresponding cross sectional area of the ear.

8. The crushing shell as claimed in claim 1, comprising between two to six ears, each ear having a respective lug.

9. The crushing shell as claimed in claim 8, comprising between four to six ears symmetrically arranged around the axis and spaced apart from one another in the circumferential direction by a uniform separation distance.

10. A gyratory crusher topshell assembly comprising:
   - a topshell terminated at an axial end by an annular rim;
   - a crushing shell including an annular wall extending around a longitudinal axis, the wall being terminated at an axial end by an annular rim, a plurality of fastening ears projecting radially outward from the wall at a region of the rim of the wall, each ear being engageable with the annular rim of the topshell, each ear having a notch, and a lock lug projecting from each ear and arranged to be received within respective recesses at the annular rim of the topshell to rotatably lock the crushing shell at the topshell, each lug having a length in a circumferential direction around the longitudinal axis that is less than half of a corresponding circumferential length of a respective ear, wherein the circumferential length of each lug is greater than a radial width of each lug, and the circumferential length of each lug is about half of a distance in the circumferential direction between an end face of the ear and the notch;

a plurality of attachment bolts, each bolt being arranged to extend through each ear and the annular rim of the topshell to axially lock the crushing shell at the topshell; and a plurality of recesses provided at the annular rim of the topshell to receive the respective lugs.

11. The assembly as claimed in claim 10, further comprising at least one extractor mounted at the topshell and including an axially adjustable shaft having an engaging end positioned to contact respectively at least one of the lugs to force axially movement of the crushing shell relative to the topshell.

12. The assembly as claimed in claim 10, wherein the topshell annular rim comprises an axially upper annular rim and an axially lower annular rim.

13. A gyratory crusher comprising a topshell assembly as claimed in claim 10.

14. The assembly as claimed in claim 12, wherein said crushing shell further comprises a first axially upper crushing shell secured via the ears, lugs and recesses to the upper annular rim of the topshell and a second axially lower crushing shell secured via the respective ears, lugs and recesses to the lower annular rim of the topshell.

* * * * *